US007077418B2

(12) United States Patent
Heftberger et al.

(10) Patent No.: US 7,077,418 B2
(45) Date of Patent: Jul. 18, 2006

(54) LIGHT-WEIGHT CONSTRUCTION CORE AND A METHOD FOR PRODUCING THE SAME

(75) Inventors: Josef Heftberger, Rottenbach (AT); Josef Holovicz, Mettmach (AT)

(73) Assignee: Fischer Gesellschaft m.b.H., Ried Im Innkreis (AT)

( * ) Notice: Subject to any disclaimer, the term of this patent is extended or adjusted under 35 U.S.C. 154(b) by 108 days.

(21) Appl. No.: 10/747,882

(22) Filed: Dec. 29, 2003

(65) Prior Publication Data

US 2005/0082789 A1 Apr. 21, 2005

Related U.S. Application Data

(63) Continuation of application No. PCT/AT02/00198, filed on Jul. 8, 2002.

(30) Foreign Application Priority Data

Jul. 10, 2001 (AT) ..... A 1077/2001

(51) Int. Cl.
*A63C 5/12* (2006.01)

(52) U.S. Cl. ..... 280/601; 280/609; 280/610

(58) Field of Classification Search ..... None
See application file for complete search history.

(56) References Cited

U.S. PATENT DOCUMENTS

| | | | | |
|---|---|---|---|---|
| 3,194,572 | A * | 7/1965 | Josef | 280/610 |
| 3,369,821 | A * | 2/1968 | Weber | 280/610 |
| 3,698,731 | A * | 10/1972 | Jost et al. | 280/610 |
| 4,077,652 | A * | 3/1978 | McCaskey et al. | 280/610 |
| 4,147,377 | A * | 4/1979 | Plenk | 280/609 |
| 4,359,077 | A * | 11/1982 | Staufer | 144/371 |
| 4,530,871 | A * | 7/1985 | You | 428/111 |
| 5,160,158 | A * | 11/1992 | Scherubl | 280/610 |
| 5,328,200 | A * | 7/1994 | Pelizzari | 280/609 |
| 5,344,177 | A * | 9/1994 | Rouser et al. | 280/610 |
| 5,690,349 | A * | 11/1997 | Rohrmoser | 280/610 |
| 5,725,237 | A * | 3/1998 | Krafft et al. | 280/609 |
| 5,921,564 | A * | 7/1999 | Olson | 280/14.21 |
| 6,183,000 | B1 * | 2/2001 | Piatti | 280/610 |

FOREIGN PATENT DOCUMENTS

| | | |
|---|---|---|
| AT | 231323 | 5/1963 |
| DE | 1 478 123 | 10/1969 |
| DE | 1 916 043 | 10/1970 |
| DE | 21 51 944 A | 4/1972 |
| DE | 21 12 307 A | 10/1972 |
| DE | 36 39 411 A | 2/1988 |
| EP | 0320487 | 6/1989 |
| FR | 2 599 265 | 12/1987 |
| WO | WO 86/04512 | 8/1986 |
| WO | WO 93/19824 | * 10/1993 |

* cited by examiner

*Primary Examiner*—Christopher P. Ellis
*Assistant Examiner*—Christopher Bottorff
(74) *Attorney, Agent, or Firm*—Martin Fleit; Paul D. Bianco; Fleit Kain Gibbons Gutman Bongini & Bianco P.L.

(57) ABSTRACT

A light-weight construction core made of wood for sliding bodies, e.g., skis, in particular cross-country skis, having grooves or slits (3), respectively, arranged in longitudinal rows, which grooves or slits extend in the longitudinal direction of the ski and are offset row-wise relative to each other, wherein the grooves or slits (3), respectively, preferably in the binding region are formed to be open towards the running surface only and—viewed in longitudinal section—are designed to be circular-arc-shaped or elongate having rounded corners.

6 Claims, 2 Drawing Sheets

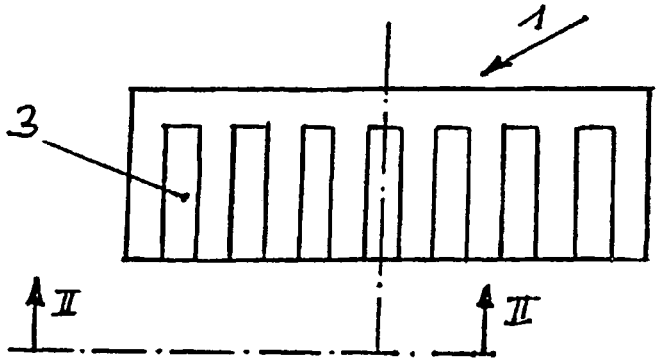
Fig. 1
Fig. 2
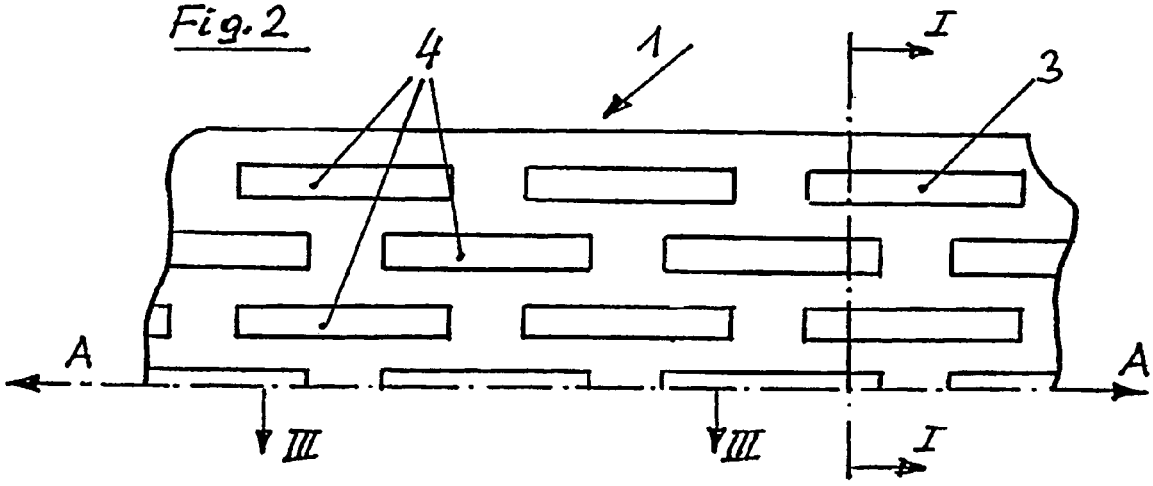
Fig. 3
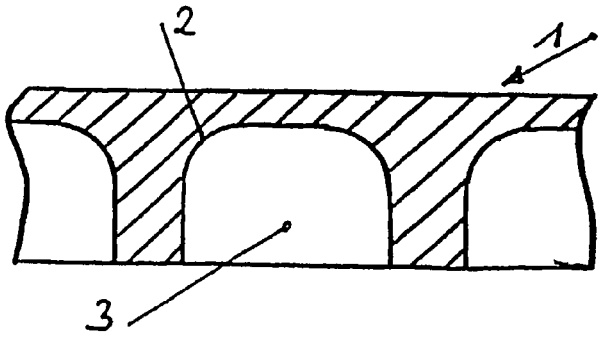

LIGHT-WEIGHT CONSTRUCTION CORE AND A METHOD FOR PRODUCING THE SAME

RELATED APPLICATION

This application is a continuation of International Application PCT/AT02/00198, filed Jul. 8, 2002, the contents of which are here incorporated by reference in their entirety.

BACKGROUND OF THE INVENTION

1. Field of the Invention

The invention relates to a light-weight construction core, and to a method for producing the same. The light-weight construction core is particularly useful for incorporation in alpine skis, cross-country skis, jumping skis and other types of skis or the like sliding bodies and devices.

A further object of the invention is a method of producing the light-weight construction core.

2. Prior Art

So far, honeycomb-type cores have been used for reducing the weight of the subject skis.

From AT 231 323 B a ski has become known in which a core consisting of a honey-comb core material with cell foils provided in vertical position, is arranged between a supporting top and a supporting bottom cover sheet, the cell foils which are made of a corrugated material being oriented parallel to each other and to the longitudinal ski axis and extending over the entire height of the ski core. The corrugated foils not only render the production of the ski inconvenient, but it has also been shown that such a ski will meet the demands made thereon in terms of torsional stiffness and flexural strength only if certain specific construction features are provided; particularly so in case of a cross-country ski.

From DE-OS 19 16 043, a construction part for a ski designed as a foamed body has become known which has recesses which are already left clear during the production of the foamed body by insertion of cylindrical elements and do not have an offset arrangement.

From DE 36 39 411 A1, a ski core has become known which consists of side coats of a synthetic or plastic material, and a composite insert made of wood, which is provided with incisions from both the top and bottom sides and which is elastically compressible so as to obtain a ski with a waist.

SUMMARY OF THE INVENTION

On the other hand, the present invention has as its object to provide a light-weight construction core which has good strength properties with a high reduction of weight, and which, moreover, makes it possible to anchor binding screws on the remainder of the core surface. Accordingly, the present invention comprises a light-weight construction core made of wood for sliding bodies, e.g., skis, in particular cross-country skis, having grooves or slits, respectively, arranged in longitudinal rows, which grooves or slits extend in the longitudinal direction of the ski and are offset row-wise relative to each other, characterized in that the grooves or slits, respectively, preferably in the binding region are formed to be open towards the running surface only and—viewed in longitudinal section—are designed to be circular-arc-shaped or elongate having rounded corners. According to the invention, this object is achieved by the measure described herein. Moreover, due to the grooves being only open on the running surface side as compared to the known incisions that are provided in both sides of the ski, substantially better running properties are achieved.

The feature according to a further aspect of the invention manifests in the light-weight construction core according to the above, characterized in that the grooves or slits, of which there are preferably three (3) of the neighboring groove rows are offset by half the groove length relative to each other. This ensures a particularly high core stability relative to the optimum weight reduction.

The invention further contemplates a method of producing a light-weight construction core according to at least one of the descriptions of the invention, characterized in that when using wood as the core material, the grooves or slits, respectively, are made by moving circular saws into the core material in steps. By the method noted, a particularly economical and simple production of the core can be achieved.

The invention further contemplates a method according to the above, characterized in that the core is pressed together in at least twice the width of the skis to be produced and subsequently is cut into individual ski widths. By this method it is possible to produce two pieces of skis in one pressing procedure, thereby doubling the net product in the realm of the presses.

In combination with the methods noted above, a method is contemplated, characterized in that the core is pressed together of adhesive-bonded lamellae extending in the longitudinal direction of the ski and at least in the binding region, is made with wall portions for the introduction of screws in transverse direction offering a further advantageous development of the method of the invention.

BRIEF DESCRIPTION OF THE DRAWINGS

Further features of the invention will be explained in more detail by way of the drawings in which two exemplary embodiments of the subject matter of the invention have been illustrated.

FIG. 1 shows a middle cross-section of a double core in the direction of arrow I—I of FIG. 2;

FIG. 2 shows a bottom view of the core according to FIG. 1 in the direction of arrow II—II;

FIG. 3 shows a section in the direction of the arrow III—III of FIG. 2;

DETAILED DESCRIPTION OF PREFERRED EMBODIMENTS OF THE INVENTION

In FIG. 1, a double core is indicated by 1 which is adhesive-bonded of lamellae extending in the longitudinal direction of the ski. From the running surface side, grooves 3 or slits, respectively, are cut into the core 1, preferably by incisions made by means of a circular saw, which grooves are arranged in successive rows 4 extending parallel to the longitudinal axis A—A of the ski, the successive grooves 3 having equal lengths and, in the present case, being offset by half a groove length relative to the grooves of the neighboring row. By moving the saw blade or the saw blades, respectively, in parallel to the longitudinal axis A—A of the ski, or in the longitudinal axis of the latter, respectively, as shown in FIG. 3, elongate grooves having rounded corners 2 are produced. Of course, it is also possible to move the ski relative to the saw blade in the longitudinal direction of the ski. What is essential is that when making grooves extending in longitudinal direction of the ski, both, a relative movement between ski and saw blade in the longitudinal direction of the ski takes place, and also the circular saw carries out a longitudinal movement in the opposite direction.

The offset of the grooves can be made in any other relationship, uniformly or non-uniformly. In this way, the grooves will be interrupted by the core material either in periodical or in statistical distances, so that with an optimum reduction of the ski weight, there will be a sufficient gluing area for the fastening of belts on the running side, running surface coatings and/or the like, wherein the side walls delimiting the core may be made thicker than the intermediate walls of neighboring grooves so as to attain a lateral pressure stability relative to the transverse axis of the ski and the longitudinal axis of the ski.

As shown in FIG. 3, the grooves extend in the longitudinal direction of the ski and have rounded corners 2.

Figure 4:
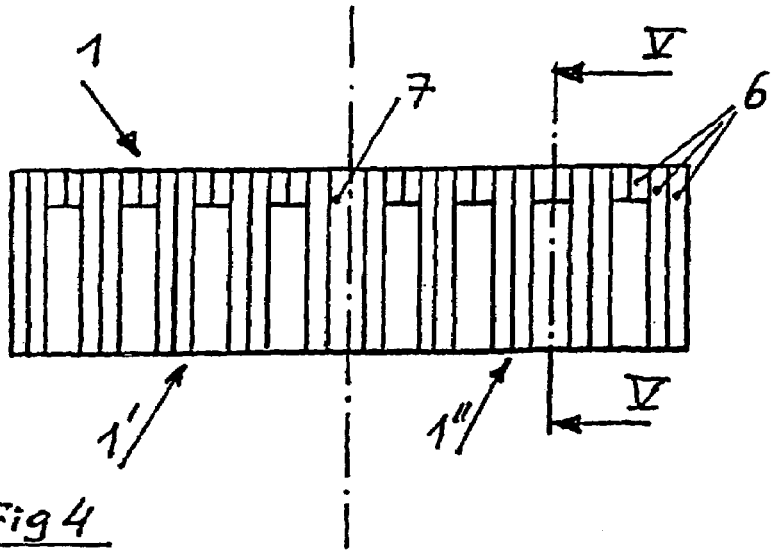
FIG. 4 shows a cross-section of a double core similar to the embodiment according to FIG. 1, wherein the adhesive bonding of the individual boards is indicated.
Figure 5:
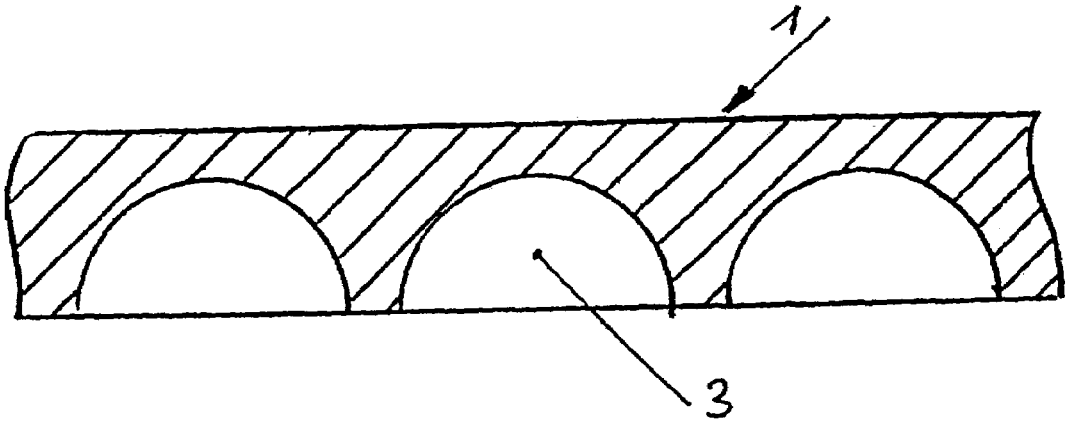
FIG. 5 shows a section according to line V—V of FIG. 4.

In the embodiment of the light-weight construction core according to FIGS. 4 and 5, the lamellae which are adhesive-bonded to each other are denoted by 6.

In this embodiment of the light-weight construction core, the grooves 3, as shown by FIG. 5, are semi-circular in shape and are formed by simply moving the circular saw into the core 1. The grooves may, of course, also be sector-shaped.

In the double core illustrated, a massive longitudinal web 7 is provided in the middle region which has twice the width of the lamellae 6 and, when parting the core into individual cores 1', 1", as indicated by dot and-dash lines, is cut apart.

Within the scope of the invention, of course, also various structural changes may be made, as will be apparent to a person skilled in the art from a knowledge of the disclosure and teachings herein. For example, thus, it is possible to fill the grooves in the region of the screw fastenings with a material in which binding screws or the like fastening means can be introduced.

What is claimed is:

1. A light-weight construction core made of wood for sliding bodies, having at least three grooves or slits arranged in longitudinal rows, which grooves or slits extend in the longitudinal direction of the ski and are offset row-wise relative to each other, characterized in that the grooves or slits, are formed to be open towards the running surface only and—viewed in longitudinal section—each groove or slit has a circular-arc-shape defining a top surface and two longitudinal end surfaces.

2. A light-weight construction core made of wood for sliding bodies, having at least three grooves or slits arranged in longitudinal rows, which grooves or slits extend in the longitudinal direction of the ski and are offset row-wise relative to each other, characterized in that the grooves or slits, are formed to be open towards the running surface only and—viewed in longitudinal section—have a circular-arc-shape or elongate shape having rounded corners, and further characterized in that the grooves or slits of the neighboring groove rows are offset by half the groove length relative to each other.

3. A method of producing a light-weight construction core according to claim 1, characterized by the steps of using wood as the core material, and forming the grooves or slits, respectively, by moving a circular saw into the core material in steps.

4. A method according to claim 3, characterized in that the core is formed by pressing together a core material in at least twice the width of the skis to be produced and subsequently cutting the pressed core material into individual ski widths.

5. A method according to claim 3, characterized in that the core is pressed together of adhesive-bonded lamellae extending in the longitudinal direction of the ski and at least in the binding region, is made with wall portions for the introduction of screws.

6. A light-weight construction core made of wood for sliding bodies, having at least three grooves or slits arranged in longitudinal rows, which grooves or slits extend in the longitudinal direction of the ski and are offset row-wise relative to each other, characterized in that the grooves or slits are formed to be open towards the running surface only and, viewed in longitudinal section, each groove or slit has an elongate shape including a top surface, two longitudinal end surfaces, and rounded corners connecting the top surface with the longitudinal end surfaces.

* * * * *